US008217848B2

(12) United States Patent
Girard et al.

(10) Patent No.: US 8,217,848 B2
(45) Date of Patent: Jul. 10, 2012

(54) REMOTE ELECTRICAL TILT ANTENNA WITH MOTOR AND CLUTCH ASSEMBLY

(75) Inventors: Gregory Girard, Saint-Roch (FR); Frank Soulie, Montlivault (FR); Eric Proteau, Mosnes (FR); Anthony Pallone, Civray-de-Touraine (FR)

(73) Assignee: Amphenol Corporation, Wallingford, CT (US)

( * ) Notice: Subject to any disclaimer, the term of this patent is extended or adjusted under 35 U.S.C. 154(b) by 707 days.

(21) Appl. No.: 12/369,221

(22) Filed: Feb. 11, 2009

(65) Prior Publication Data

US 2010/0201590 A1 Aug. 12, 2010

(51) Int. Cl.
*H01Q 3/00* (2006.01)

(52) U.S. Cl. ..... 343/766; 343/757; 343/765; 343/872

(58) Field of Classification Search ..... 343/757, 343/765, 766, 873, 893, 872
See application file for complete search history.

(56) References Cited

U.S. PATENT DOCUMENTS

| | | | | |
|---|---|---|---|---|
| 2,361,956 | A | 11/1944 | Moseley | |
| 5,235,344 | A | 8/1993 | Shinkawa et al. | |
| 6,175,340 | B1 | 1/2001 | Olds et al. | |
| 6,940,469 | B2 * | 9/2005 | Gottl et al. | 343/890 |
| 2002/0109047 | A1 | 8/2002 | Draisey et al. | |
| 2005/0057427 | A1 | 3/2005 | Wensink | |
| 2005/0272470 | A1 | 12/2005 | Hurler et al. | |
| 2007/0030208 | A1 | 2/2007 | Linehan | |
| 2007/0290935 | A1 | 12/2007 | Franzon et al. | |
| 2009/0135074 | A1 * | 5/2009 | Yang et al. | 343/766 |

* cited by examiner

*Primary Examiner* — Dieu H Duong
(74) *Attorney, Agent, or Firm* — Blank Rome LLP

(57) ABSTRACT

RET antenna with motor and clutch assembly that is operative to mechanically disengage the DC motor and drive unit (also called the gear-motor unit) from the phase shifter adjustment shaft during a manual tilt operation. Disengaging the gear-motor unit removes the drag of the motor and the high gear ratio gear box from the phase shifter control rod making it easier to manually turn the phase shifter control knob. In addition, the clutch disengages the gear-motor without disengaging the position detector from the phase shifter control rod so that position calibration is not lost during manual tilt adjustment. When the manual tilt operation is completed, the mechanical tilt clutch enables the gear-motor unit to be reliably re-engaged with the phase shifter control rod for motorized electrical tilt operation without having to re-calibrate the position detector.

20 Claims, 9 Drawing Sheets

REMOTE ELECTRICAL TILT ANTENNA WITH MOTOR AND CLUTCH ASSEMBLY

REFERENCE TO PRIORITY APPLICATIONS

This application claims priority to commonly-owned U.S. Provisional Patent Application No. 61/027,530, which is incorporated herein by reference.

TECHNICAL FIELD

This invention relates to the field of cellular or mobile telephone base station antennas and, more particularly, relates to a remote electrical tilt (RET) base station antenna with a motor and clutch assembly that disengages the tilt motor to facilitate manual tilt adjustment.

BACKGROUND OF THE INVENTION

Antennas with variable electrical tilt (VET) functionality are known in the art. These antennas, which often are used in cellular networks, enable network operators to tilt the elevation beam pointing direction of an antenna by manually rotating a knob or translating a shaft on the exterior of the antenna. The knob or shaft is linked to phase shifters inside the antenna to convert the mechanical rotation or translation of the shaft to phase changes in the radio frequency beam forming network inside the antenna. Changes in phase between radiating elements inside the antenna cause the beam emitted from the antenna to tilt up or down relative to mechanical boresite of the antenna. An example of a cellular base station antenna demonstrating VET technology is depicted in U.S. Pat. No. 7,068,236, which is incorporated by reference.

Beam tilt adjustment is needed in cellular networks to reduce signal propagation between sites in the network in order to minimize signal interference and to maximize network capacity. Antennas with VET functionality allow network operators to make accurate tilt adjustments at a cell site without mechanically tilting the antenna and without changing the visual appearance of the site. Antennas with VET functionality typically include some sort of tilt indicator to provide visual feedback of the antenna electrical tilt setting to the person making the tilt adjustment.

Remote electrical tilt (RET) antennas are also known in the art. RET antennas incorporate an electro-mechanical actuator attached to or installed inside of the antenna to rotate the knob or translate the shaft on a VET antenna. This enables the electrical tilt of the VET antenna to be controlled from a remote location, eliminating the expense of hiring a rigger to climb the tower and manually adjust the electrical tilt of the antenna beam.

With most RET antennas, the electro-mechanical actuator attaches to the VET antenna at or near the manual tilt adjustment mechanism of the antenna. With the RET actuator installed, the tilt of the antenna can no longer be adjusted manually. In order to manually adjust the tilt of the antenna, the RET actuator must be physically removed or separated from the antenna to provide access to the manual tilt adjustment mechanism. Removing the actuator is often tedious and time consuming due to small attachment screws and delicate interface components. In addition, calibration can be lost between the electro-mechanical actuator and the antenna tilt setting once the actuator is removed. A calibration sequence must to be run to re-calibrate the actuator to the antenna before proper remote operation can be restored.

An improvement on the standard RET antenna design is depicted in U.S. Pat. No. 7,286,092, which is incorporated by reference. In this design, the electro-mechanical actuator inserts inside the antenna body without blocking access to the manual tilt adjustment mechanism of the antenna. With the RET actuator engaged, the tilt of this antenna can be adjusted manually using a 10 mm wrench to rotate the tilt adjustment mechanism. In this design, the wrench is needed to overcome the mechanical resistance of the phase shifters plus the mechanical resistance of the motor. In this design, the motor does not separate from the drive chain during a manual tilt operation.

A low gear ratio drive unit is required in this design to enable manual tilt adjustment with the RET actuator is installed. The low gear ratio drive unit allows the motor and the drive unit to be manually turned with relatively low drive torque. If a high gear ratio drive unit were used, it would be very difficult to adjust the tilt manually and the high torque required to manually back-drive the motor and the drive unit could potentially break the plastic teeth on the tilt indicator drive shaft.

A problem with using low gear ratio drive units, however, is that a higher torque DC motor is required to generate sufficient torque to operate the RET actuator during remote tilt operation. The high torque DC motor is expensive by itself. In addition, the motor draws high current during tilt operations forcing the use of expensive, high current rated components on the controller circuit.

There is, therefore, a continuing need for a RET antenna that uses low current, low torque DC motors to reduce cost without losing the ability to manually tilt the antenna when the electro-mechanical actuator is installed. A further need exists for a RET antenna that allows for both electro-mechanical and manually tilt adjustment without losing the tilt calibration of the antenna.

SUMMARY OF THE INVENTION

The present invention meets the need described above in a RET antenna with a motor and clutch assembly that is operative to mechanically disengage the DC motor and drive unit (also called the gear-motor unit) from the phase shifter adjustment shaft during a manual tilt operation. Disengaging the gear-motor unit removes the drag of the motor and the high gear ratio gear box from the phase shifter control rod making it easier to manually turn the phase shifter control knob. In addition, the clutch disengages the gear-motor without disengaging the position detector from the phase shifter control rod so that position calibration is not lost during manual tilt adjustment. When the manual tilt operation is completed, the mechanical tilt clutch enables the gear-motor unit to be reliably re-engaged with the phase shifter control rod for motorized electrical tilt operation without having to re-calibrate the position detector.

The invention may be practiced in a base station antenna for a telecommunications system that is configured for remote electrical tilt ("RET") and manual tilt adjustment. The base station antenna may be a single or multiple-beam antenna with single or dual polarization elements. In a preferred embodiment, the base station antenna includes three dual polarization antenna arrays supported within a common antenna enclosure. Typically, one phase shifter can be used to control the pointing direction of an associated single or dual polarization antenna element. In some cases, one of the antenna elements serves as a pivot point for beam tilting and, for this reason, need not have an associated phase shifter. The features of a single antenna array will be described as representative of each array for descriptive convenience, it being understood that the antenna may include multiple arrays, single or dual polarization antenna elements as a matter of design choice. The antennas also include a wide range of other features that have been omitted from the description as ancillary to the present invention.

Generally described, the antenna includes a number of antenna elements for directing a beam of magnetic energy in a propagation direction. A number of phase shifters, typically one for each antenna element, are operatively connected to the antenna elements for tilting the beam propagation direction. A control device is operatively connected to the phase shifters for operating the phase shifters to tilt the beam propagation direction. A gear-motor unit is operatively connected to the control device for electro-mechanically driving the control device to tilt the beam propagation direction. In addition, a manual beam tilt mechanism is operatively connected to the control device for manually driving the control device to tilt the beam propagation direction. A clutch is operative for disengaging the gear-motor unit from the control device to facilitate manual adjustment of the beam propagation direction and reengaging the gear-motor unit with the control device to permit electro-mechanical adjustment of the beam propagation direction. The antenna may also include a position detector operatively connected to the control device for registering movement of the control device to track changes in the beam propagation direction. The position detector remains operatively connected to the control device during manual and electro-mechanical adjustment of the beam propagation direction so that beam tilt calibration is not lost during manual or electro-mechanical adjustment of the beam propagation direction.

In a particular embodiment, the antenna includes a removable cover configured to be selectively attached to the antenna to prevent access to the manual beam tilt mechanism and removed to permit access to the manual beam tilt mechanism. Manual removal of the cover operates the clutch to disengage the gear-motor unit from the control device to facilitate manual adjustment of the beam propagation direction. Similarly, manual attachment of the cover operates the clutch to reengage the gear-motor unit with the control device to permit electro-mechanical adjustment of the beam propagation direction.

More specifically, the clutch may include a spring-loaded plunger mechanism that selectively moves a drive gear unit into and out of engagement with a control gear operatively connected to the control device. The spring-loaded plunger mechanism may include a slide supporting the gear-motor unit that is slidably engaged within a guide frame inside the antenna. The control device may include a control rod that rotates to adjust the beam propagation direction, and the manual beam tilt mechanism may include a tilt adjustment knob connected to the control rod for manually rotating the control rod.

In addition, the antenna is typically housed within an enclosure, the control extends through the antenna enclosure, and the tilt adjustment knob is connected to the control rod outside and proximate to the antenna enclosure. In this arrangement, the removable cover selectively attaches to the antenna enclosure to cover tilt adjustment knob. To operate the clutch, the removable cover includes a collar configured to be manually inserted into the antenna enclosure to push the spring-loaded plunger mechanism against a spring bias of the mechanism to move the drive gear into engagement with the control gear when the cover is attached to the antenna enclosure. The spring-loaded plunger mechanism is further configured to move under the spring bias of the mechanism to disengage the drive gear from the control gear when the collar of the removable cover is manually removed from the antenna enclosure.

The antenna may also include a tilt indicator operatively carried by the control rod located at least partially outside the antenna enclosure visually indicating a tilt setting associated with the beam propagation direction. In this case, the removable cover may include a sight tube permitting visual access to the tilt indicator when the removable cover is attached to the antenna enclosure and covering the tilt indicator.

In view of the foregoing, it will be appreciated that the present invention provides a cost effective RET antenna that includes a mechanical clutch that separates a low current, low torque DC motor from the tilt adjustment mechanism to permit manual tilt adjustment of the antenna. The RET antenna also allows both electro-mechanical and manually tilt adjustment without losing the tilt calibration of the antenna. The specific techniques and structures for implementing particular embodiments of the invention, and thereby accomplishing the advantages described above, will become apparent from the following detailed description of the embodiments and the appended drawings and claims.

DETAILED DESCRIPTION OF THE EMBODIMENTS

Figure 1:
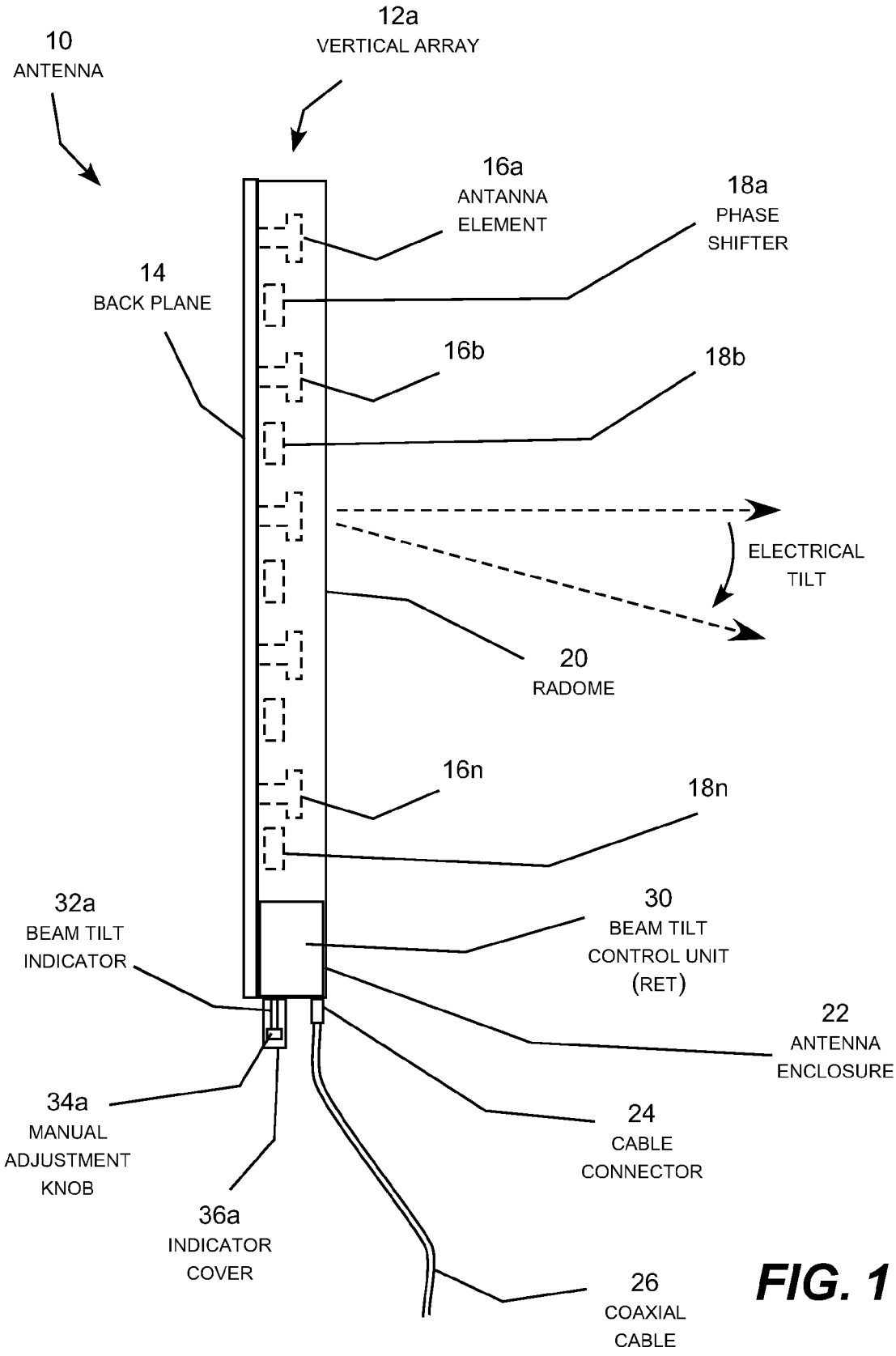
FIG. 1 is a conceptual illustration of a side view of a remote electrical tilt antenna with a motor and clutch assembly to facilitate manual tilt adjustment.

The present invention meets the need described above in a RET antenna with a motor and clutch assembly that is operative to mechanically disengage the DC motor and drive unit (also called the gear-motor unit) from the phase shifter adjustment shaft during a manual tilt operation. Disengaging the gear-motor unit removes the drag of the motor and the high gear ratio gear box from the phase shifter control rod making it easier to manually turn the phase shifter control knob. In addition, the clutch disengages the gear-motor without disengaging the position detector from the phase shifter control rod so that position calibration is not lost during manual tilt adjustment. When the manual tilt operation is completed, the mechanical tilt clutch enables the gear-motor unit to be reliably re-engaged with the phase shifter control rod for motorized electrical tilt operation without having to re-calibrate the position detector.

The mechanical tilt clutch incorporates a shaft position detector to provide feedback to the remote control system to identify the current beam tilt of the antenna. To maintain the tilt calibration of the antenna, the shaft position detector is fixed in location and does not disengage from the phase shifter drive shaft during electro-mechanical or manual or remote tilt operations. Calibration is set at the factory during antenna assembly and is not lost in the field during a manual tilt operation. The invention may be applied to single band antennas with only one electro-mechanical tilt actuator as well as multi-band antennas with multiple electro-mechanical tilt actuators.

In the particular embodiment illustrated in the figures, the mechanical tilt clutch allows the DC motor and drive unit to be engaged and disengaged from the exterior of the antenna using the tilt indicator cover. When the tilt indicator cover is installed on the antenna body it encapsulates the manual tilt adjustment drive unit for the antenna, preventing access for manual operation. At the same time, the installed tilt indicator cover causes the DC motor and drive unit to become engaged with the phase shifter drive shaft. In this position, the antenna is ready for remote tilt operation. When the tilt indicator cover is rotated and removed from the antenna, springs internal to the antenna body apply force to the DC motor and drive unit to disengage them from the phase shifter drive shaft. Also, when the tilt indicator cover is removed, the manual tilt adjustment unit for the antenna becomes exposed. In this position, the antenna is ready for manual adjustment. With the DC motor and drive unit disengaged from the phase shifter drive shaft, manual tilt operation is possible without back driving the DC motor and drive unit. As a result, high gear ratio drive units with low current DC motors can be used, meeting the design objective of the invention.

The tilt indicator cover is tethered to the antenna body with a length of cord to prevent losing the cover when it is disengaged during a manual tilt operation. The uninstalled cover dangling at the end of the cord is highly visible to the operator performing the manual tilt operation. It is very unlikely that the operator would leave the site without remembering to re-install the tilt indicator cover. It would be easy to visually inspect the antenna from the ground with binoculars to verify whether or not the tilt indicator cover had been properly reinstalled.

Another embodiment of this invention could include turning a lever, pushing a button or rotating a screw on the exterior of the antenna to disengage the DC motor and drive unit from the phase shifter drive shaft. This is a less desirable solution since the screw, button or lever would be less visible than an uninstalled tilt indicator cover. The operator might forget to re-engage the device after completing the manual tilt operation and it would be difficult to verify proper reinstallation without climbing the tower.

Another embodiment of this invention could be to press and hold or turn and hold a feature of the antenna to disengage the DC motor and drive unit during a tilt operation. When the manual tilt operation is completed the feature would be released. Springs inside the antenna could re-engage the DC motor and drive unit with the phase shifter drive shaft. This would prevent an operator from accidentally forgetting to re-engage the DC motor and drive unit but would also require two hands on the antenna during a manual tilt operation. This is undesirable from a climbing safety perspective.

Turning now to the drawings, in which like numerals refer to like elements throughout the figures, FIG. 1 is a conceptual illustration of a side view of a tri-band, dual polarization remote electrical tilt antenna 10 with a motor and clutch assembly to facilitate manual tilt adjustment. The basic construction and operation of tri-band, dual polarization remote electrical tilt antennas are well known. In brief summary, this particular example of this type of antenna includes three vertical arrays of dual-polarization antenna elements. Only one vertical array 12*a* is shown in the side view of FIG. 1 and many well known components are not shown to avoid cluttering the figure. The vertical array 12*a*, which is carried on a back plane 14, includes a number of dual-polarization antenna elements 16*a-n*, each of which has its beam elevation controlled by an associated phase shifter 18*a-n*. The phase shifters implement vertical beam tilt, as shown conceptually in FIG. 1. The antenna is covered by a radome 20 and carried within an antenna enclosureenclosure 22. The antenna as shown also includes a cable connector 24 for receiving RF antenna signals from a coaxial cable 26. Although only one cable connector shown, the antenna would typically have two cable connectors for each band, one for each polarization.

A remote electrical tilt (RET) controller 30 and an associated gear-motor unit including a DC motor and drive unit (also called the gear-motor, shown FIGS. 4 and 5) allows remote control over the electrical tilt of the antenna. The drive unit is a high gear ratio gear box that translates high speed, low torque motor rotation to lower speed, higher torque rotation of the drive gear turned by the motor. In this particular example, a relatively small number of antenna elements and associated phase shifters are shown in each vertical array to illustrate the conceptual design, but any sized array may be deployed. For example, a typical tri-band antenna 2.7 meters tall could include 7 antenna elements for the lowest frequency band and 17 antenna elements for the highest frequency band. As a design alternative, the center antenna element may serve as the electrical tilt pivot point and, for this reason, may not have an associated phase shifter for electrical tilt. Much detail, such as the power distribution networks, filters, grounding systems, RET communication equipment, and so forth have not been illustrated to avoid cluttering the figure.

In this particular antenna, the phase shifters 16*a-n* of a vertical array (corresponding to an operational frequency band of the antenna) are operated by a common phase shifter control rod. The bottom of the phase shifter control rod extends beyond the bottom of the antenna enclosure 22, where it carries a visual beam tilt indicator 32*a*. A manual adjustment knob 34*a* allows an operator to manually rotate the phase shifter control rod to adjust the electrical tilt of the corresponding array. An indicator cover 36*a* covers the beam tilt indicator 32*a* and the manual adjustment knob 34*a* to protect them from the weather. As described in more detail with reference to FIGS. 4 and 5, the antenna 10 includes a motor and clutch assembly for each vertical array that disengages the tilt motor from the phase shifter control rod to facilitate manual adjustment of the electrical tilt, which is accomplished by turning the manual adjustment knob 34*a*. More particularly, removal of the indicator cover 36*a*, which is necessary to manually access the manual adjustment knob

34*a*, mechanically causes the clutch assembly to disengage the motor from the phase shifter control rod.

Figure 2:
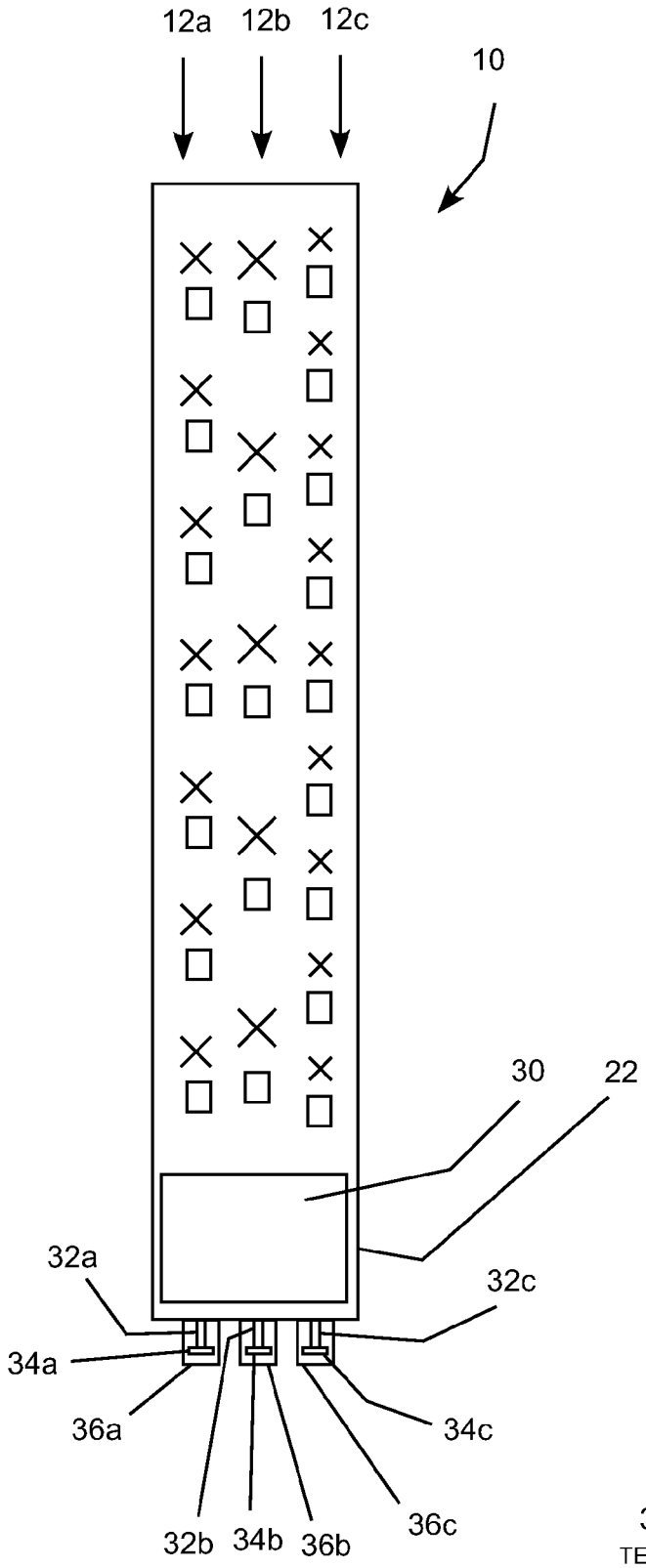
FIG. 2 is a conceptual illustration of a front view of tri-band remote electrical tilt antenna with a motor and clutch assembly to facilitate manual tilt adjustment.
Figure 3:
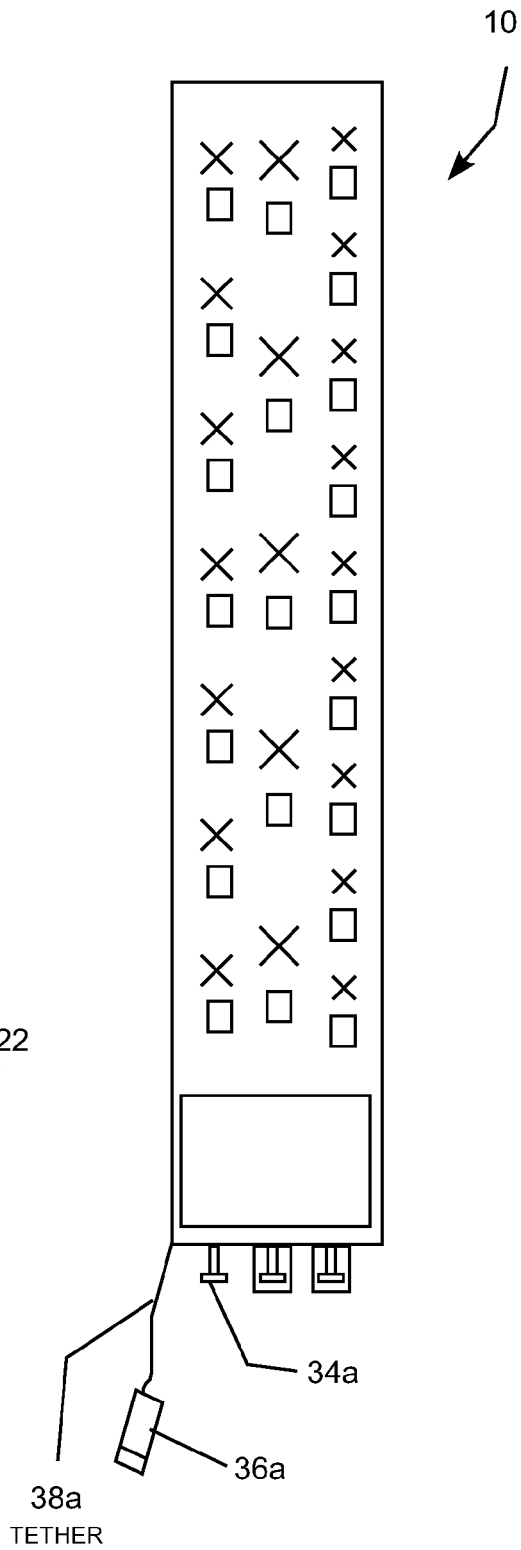
FIG. 3 is a conceptual illustration of a front view of the tri-band remote electrical tilt antenna a tilt indicator removed for manual tilt adjustment.

FIGS. 2 and 3 are conceptual illustrations of the front side of the tri-band remote electrical tilt antenna 10 without the radome. As shown in this view, the antenna includes three vertical arrays 12*a-c* of dual polarization antenna elements and associated phase shifters. The size and spacing of the antenna elements typically vary from array to array depending on the frequency band, but are shown aligned in FIG. 2 to simplify the conceptual illustration. The RET control unit is operational to control the electrical tilt of all three vertical arrays 12*a-c*, typically but not necessarily in a coordinated manner. The beam tilt indicators 32*a-c*, manual adjustment knobs 34*a-c*, and indicator covers 36*a-c* are located at the bottom of the antenna enclosure 22. As shown in FIG. 3, the indicator cover 36*a* may be removed to access the manual adjustment knob 34*a* for manual adjustment of the beam tilt of the associated array 12*a*. As noted previously, removing the indicator cover 36*a* mechanically disengages the RET beam tilt motor for the antenna array 12*a* from the associated phase shifter control rod to facilitate manual rotation of the control rod. The indicator cover 36*a* is preferably attached to the antenna enclosure 22 by a tether 38*a* so that the indicator cover will not become misplaced and to help to prompt the operator replace the indicator cover, and thereby re-engage the tilt motor, upon completion of manual tilt adjustment.

Figure 4:
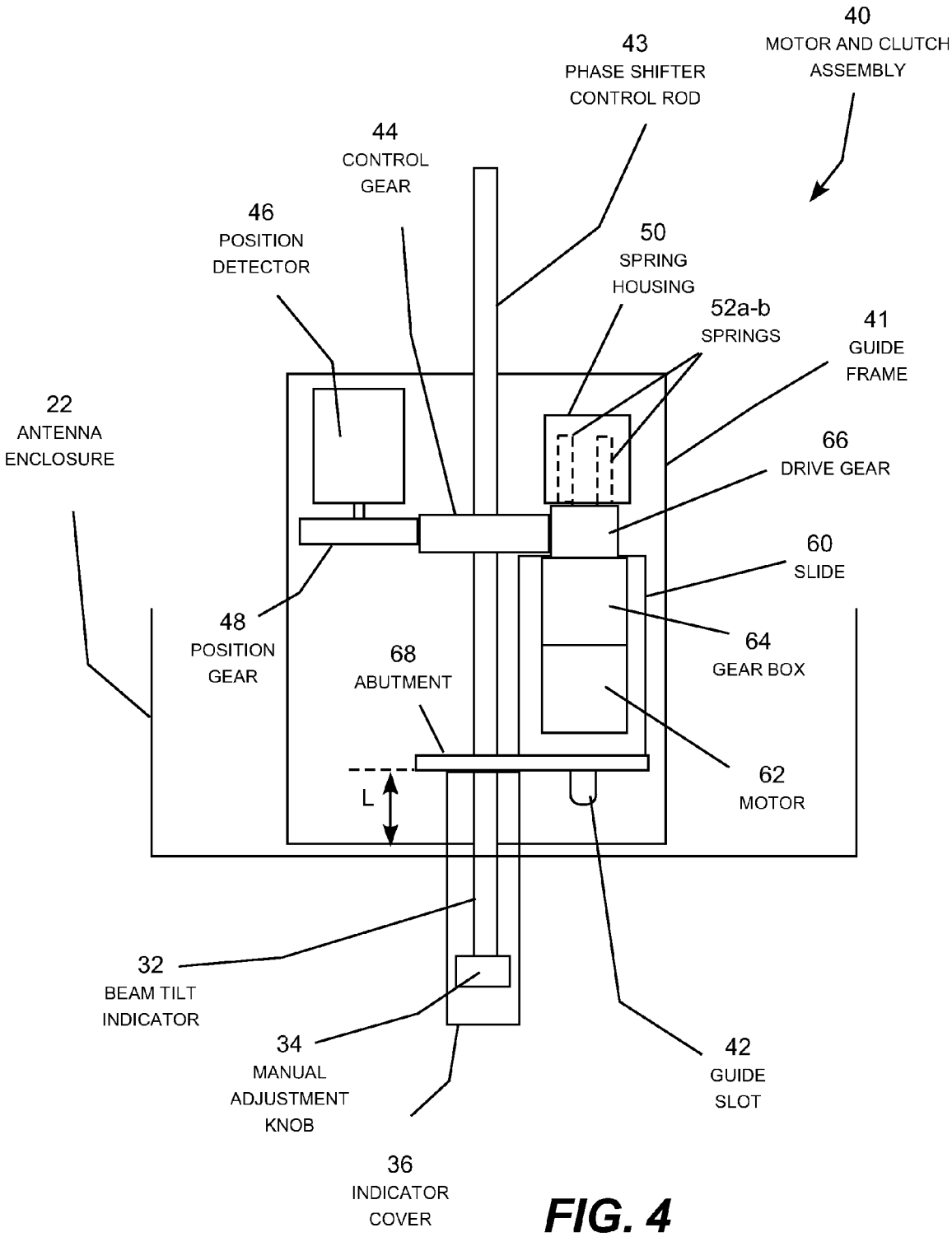
FIG. 4 is a conceptual block diagram of the motor and clutch assembly of the remote electrical tilt antenna with the motor in the engaged position.
Figure 5:
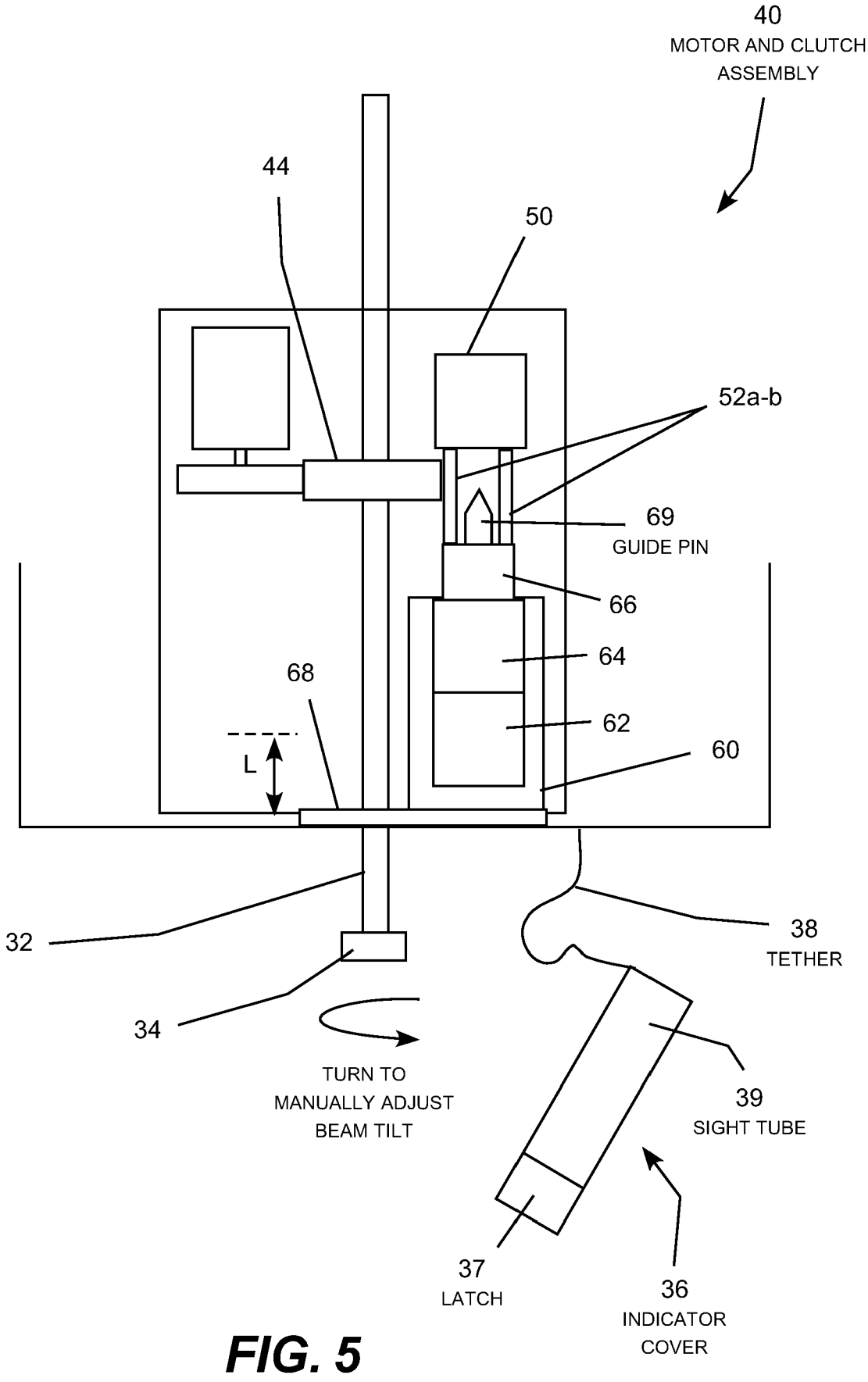
FIG. 5 is a conceptual block diagram of the motor and clutch assembly of the remote electrical tilt antenna with the motor in the disengaged position.

FIGS. 4 and 5 are conceptual block diagrams of an illustrative motor and clutch assembly 40 for the remote electrical tilt antenna 10. Each antenna array 12*a-c* has a similar motor and clutch assembly (i.e., one motor and clutch assembly per band). FIG. 4 shows the antenna with the indicator cover installed and the motor in the engaged position, whereas FIG. 5 shows the antenna with the indicator cover removed and the motor in the disengaged position. FIG. 4 shows the bottom portion of the antenna enclosure 22 with a beam tilt indicator 32, manual adjustment knob 34, and indicator cover 36 located below the enclosure. The motor and clutch assembly 40 includes a guide frame 41 that is mounted to and does not move with respect to the antenna enclosure 22. The guide frame 41 includes a guide slot 42 in which a slide 60 carrying the tilt motor 62 and associated components including a gear box 64 slides as a spring-loaded plunger mechanism. The beam tilt indicator 32 and manual adjustment knob 34 are located on the bottom portion of a phase shifter control rod 43. Rotation of the phase shifter control rod 43, whether accomplished manually by rotation of the manual adjustment knob 34 or electrically by the tilt motor 62, causes vertical translation of the phase shifter control rod, which in turn adjusts the associated phase shifters to electrically tilt the beam emitted by the associated vertical antenna array. The phase shifter control rod 43 carries a main control gear 44, which the motor 62 turns to rotate the control rod and thereby change the electrical tilt of the associated antenna array.

The guide frame 41 supports a position detector 46, typically a potentiometer, which is driven by a position gear 48. The position gear 48, in turn, is driven by the control gear 44 to provide signals indicating rotation of the control rod 43. The guide frame 41 also supports a spring housing 50 that supports two return springs 52*a-b* that bias the slide 60 downward toward the bottom of the enclosure 22. The slide 60 translates vertically within the guide slot 42 and is biased toward the bottom of the antenna enclosure 22 by the return springs 52*a-b*. The slide 60 carries the motor 62 and a high gear ratio gear box 64, which are connected together to form an integral gear-motor unit. A drive gear 66 attached to the drive shaft of the gear-motor unit can be moved into engagement with the main control gear 44 to adjust the antenna tilt. The slide 60 also includes an abutment 68 that is positioned to be pushed by the indicator cover 36 as the indicator cover is pushed into the housing 22 and turned to latch in place. Pushing the latching the indicator cover 36 moves the abutment 68 and the entire slide 60 a distance "L" as indicated in FIGS. 4 and 5. FIG. 4 shows the motor and clutch assembly 40 with the indicator cover 36 pushed in and latched to the housing 22, which corresponds to the slide 60 being displace upward by a distance "L" to engage the drive gear 66 with the control gear 44 and thereby configure the antenna for motorized electrical tilt through operation of the motor 62.

FIG. 5 shows the motor and clutch assembly 40 with the indicator cover 36 removed from the housing 22 and hanging from the tether 38. The indicator cover 36 includes a latch 37 for securing the indicator cover to the antenna enclosure and a transparent sight tube 39 for viewing the associated beam tilt indicator 32. When the indicator cover 36 has been removed as shown in FIG. 5, this allows the slide 60 to travel downward a distance "L" under the force of the return springs 52*a-b*, which disengages the drive gear 66 from the control gear 44 and thereby configures the antenna for manual electrical tilt through rotation of the manual adjustment knob 34. The engagement and disengagement of the drive gear 66 and the control gear 44 represents the clutch action of the motor and clutch assembly 40. FIG. 5 also shows a guide pin 69 on top of the drive gear 66 that moves within a corresponding guide shaft in the spring housing 50 to the keep the drive gear from slipping on the control gear 44. The slide 60 also includes a motor mount, a tie-down boss for the gear-motor unit, and two guide prongs on which the return springs 52*a-b* are carried, which are shown FIG. 13.

Figure 6:
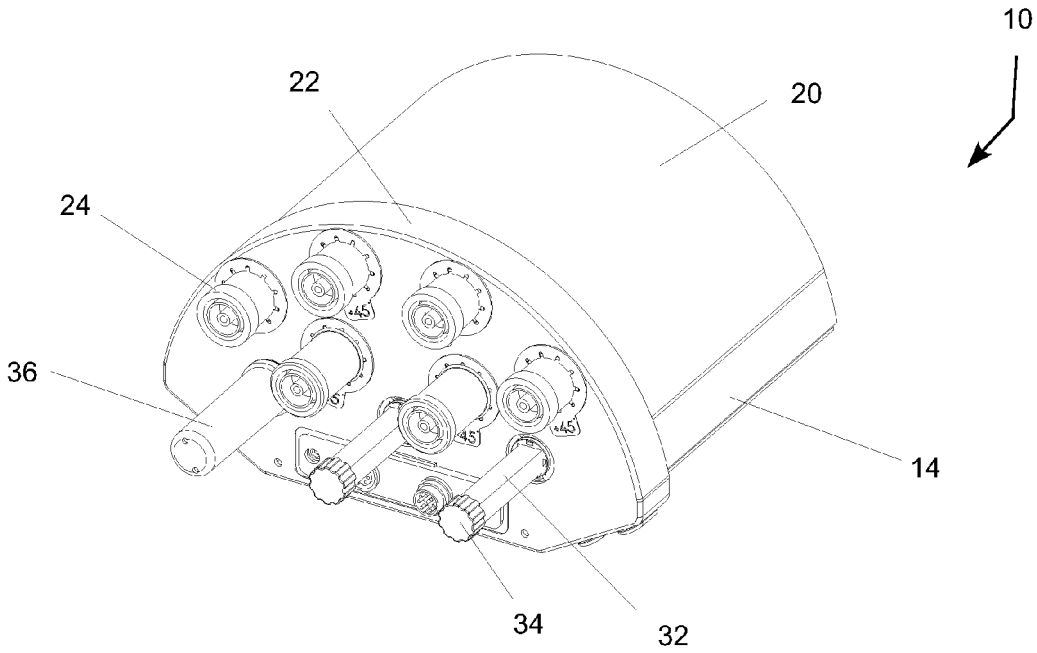
FIG. 6: is a perspective view of the bottom of a tri-band antenna showing the cable connectors, beam tilt indicators, manual adjustment knobs, and indicator covers.

FIG. 6 is a perspective view of the bottom portion of the tri-band antenna 10 shown substantially to scale. For this particular antenna, the maximum width across the bottom of the antenna enclosure 22 is approximately 10 inches (24.5 cm) and the maximum depth across the bottom of the antenna enclosure is approximately 6 inches (14.2 cm). The height of the antenna is not shown and can vary considerably for different embodiments. For example, a typical tri-beam antenna may be approximately 8 feet 10 inches (2.7 meters) tall. This view shows the radome 20, the back plane 14, and the antenna enclosure 22. The bottom of the enclosure carries six cable connectors represented by the enumerated cable connector 24. Each vertical array transmits and receives one band of the tri-band antenna, and each band has two cable connectors, one for each polarization. Also at the bottom of the enclosure, there are three beam tilt indicators represented by the enumerated tilt indicator 32, three manual adjustment knobs represented by the enumerated manual adjustment knob 34, and three indicator covers represented by the enumerated indicator cover 36.

Figure 7:
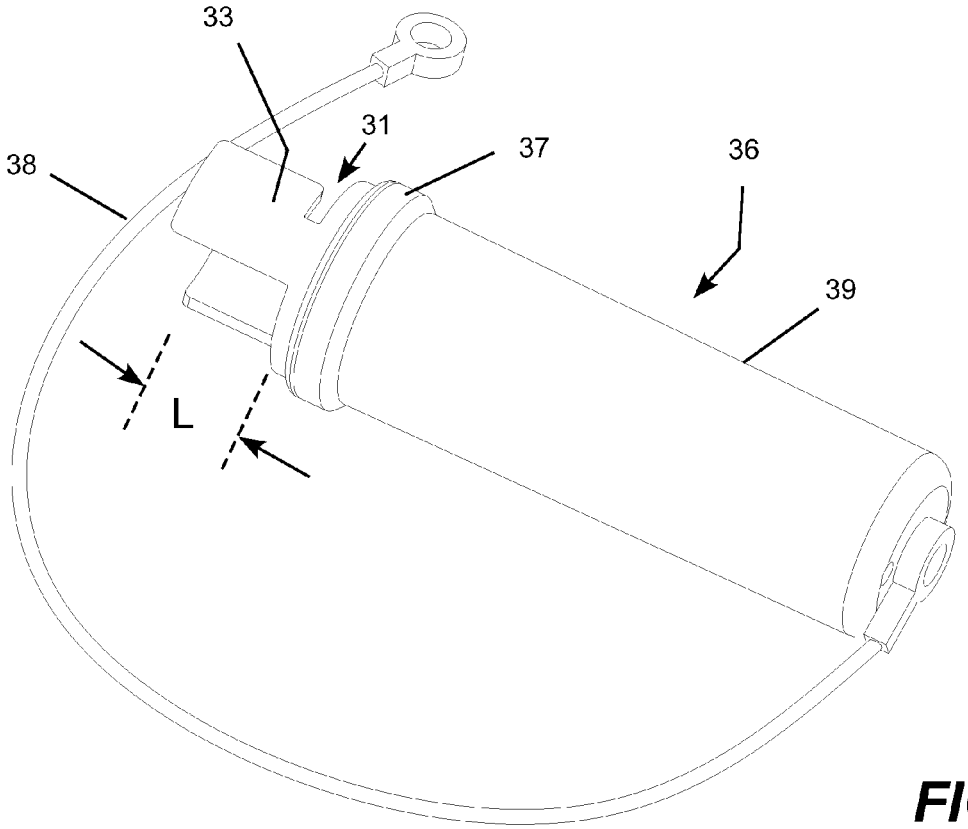
FIG. 7 is a perspective view of an illustrative indicator cover.

FIG. 7 is a perspective view of an illustrative indicator cover 36, which includes a latch 37, a tether 38, and a sight tube 39. The latch 37 includes a catch 31 that engages with a stop on the antenna enclosure 22 and a cuff 33 that extends into the antenna enclosure when the indicator cover is pushed into and turned to latch onto the housing. The distance "L" that the indicator cover moves the slide corresponds to the distance by which the cuff 33 extends beyond the catch 31. In this particular antenna, the distance "L" is approximately 0.5 inch (1.3 cm). Referring to FIGS. 4 and 5, this is the same distance "L" that the slide 60 travels to engage and disengage the drive gear 66 with the control gear 44 to implement the clutch action of the motor and clutch assembly 40.

Figure 8:
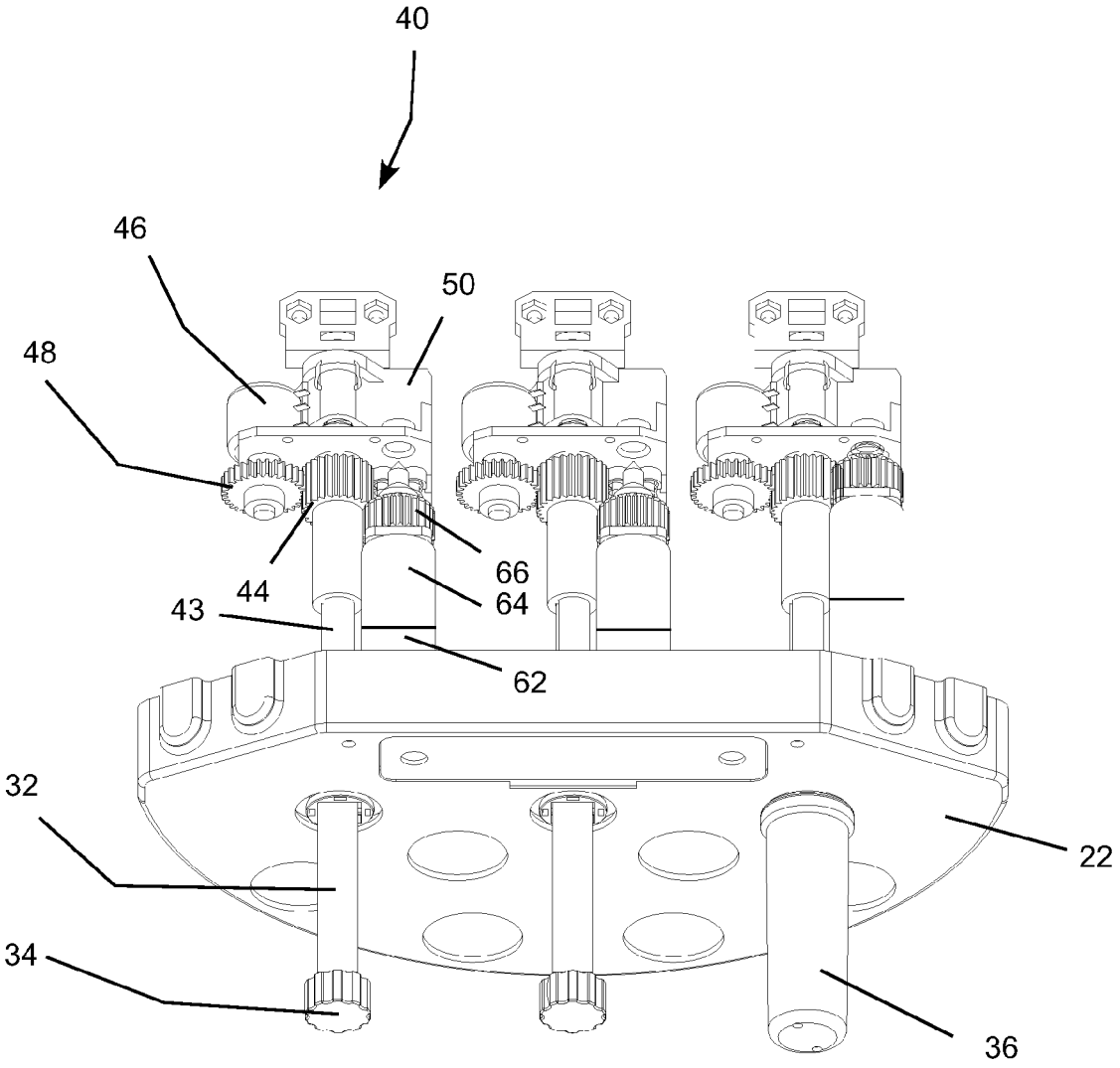
FIG. 8 is a perspective view of an illustrative motor and clutch assembly for a tri-band remote electrical tilt antenna.

FIG. 8 is a perspective view of an illustrative motor and clutch assembly 40 substantially to scale, which includes three motor and clutch units, one for each band. One representative motor and clutch assembly 40 has parts enumerated and some components are not illustrated to avoid cluttering the figure. FIG. 8 shows the beam tilt indicator 32, the manual adjustment knob 34, and the indicator cover 36 located below the antenna enclosure 22. The manual adjustment knob 34 is connected to the phase shifter control rod 43, which carries the control gear 44. The position detector 46 is driven by the position gear 48, which is engaged with the control gear 44. In this view, the motor 62, gear box 64, and drive gear 66 are shown in the disengaged position. The spring housing 50 is also shown in FIG. 8.

Figure 9:
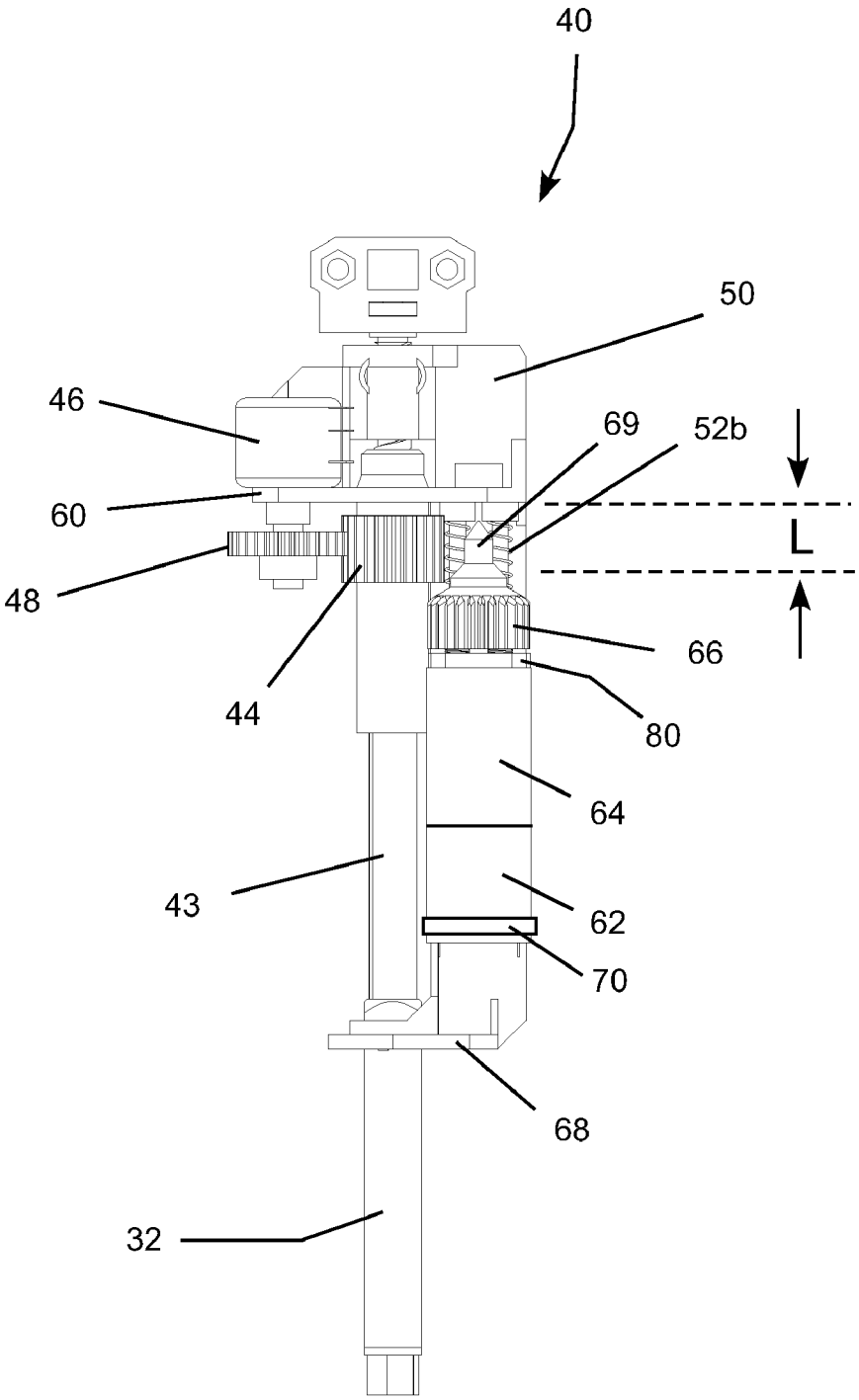
FIG. 9 is a front view of an illustrative motor and clutch assembly for a remote electrical tilt antenna.

FIG. 9 is a front view of an illustrative motor and clutch assembly 40. The beam tilt indicator 32 carried on the phase shifter control rod 43 are visible in this perspective view. This view shows the control gear 44, the position detector 46, and the position gear 48, which is engaged with the control gear 44. The slide 60, motor 62, gear box 64, drive gear 66, and abutment 68 are shown in the disengaged position. The spring housing 50 and the return springs 52*a-b* are shown with spring 52*b* labeled. The guide pin 69 on the top of the drive gear 66, a cable tie 70 that attaches the bottom of the gear-motor unit to the slide, and the motor mount 80 are also shown in FIG. 9.

Figure 10:
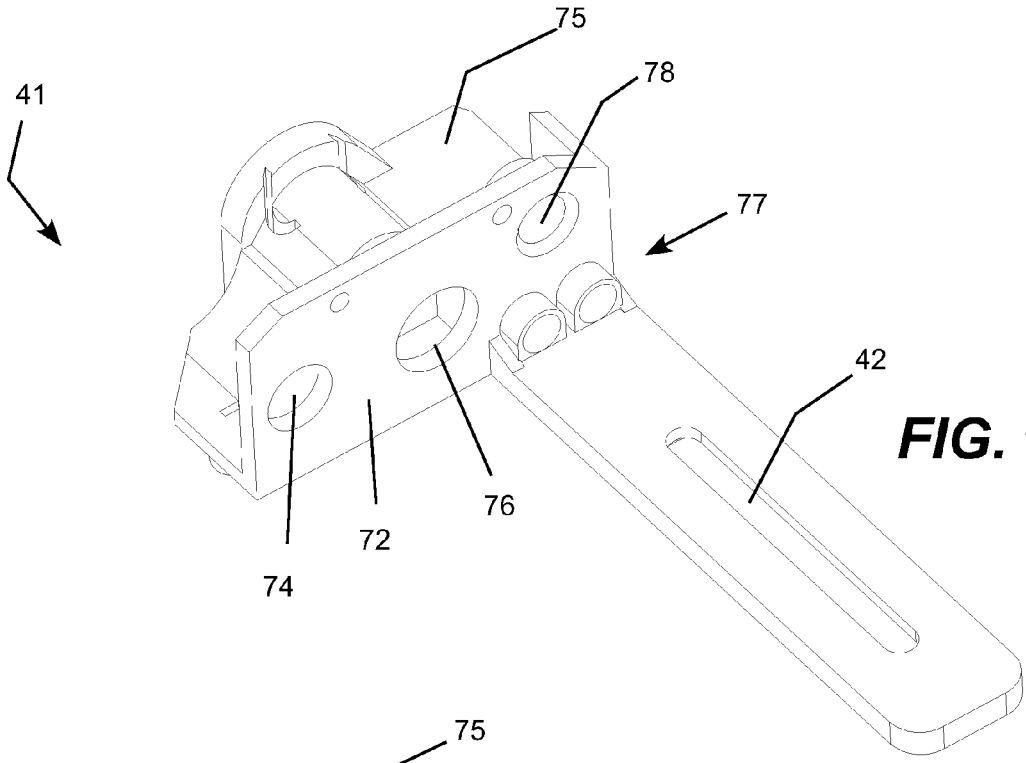
FIG. 10 is a perspective view of the front side of a guide frame for an illustrative motor and clutch assembly for a remote electrical tilt antenna.
Figure 11:
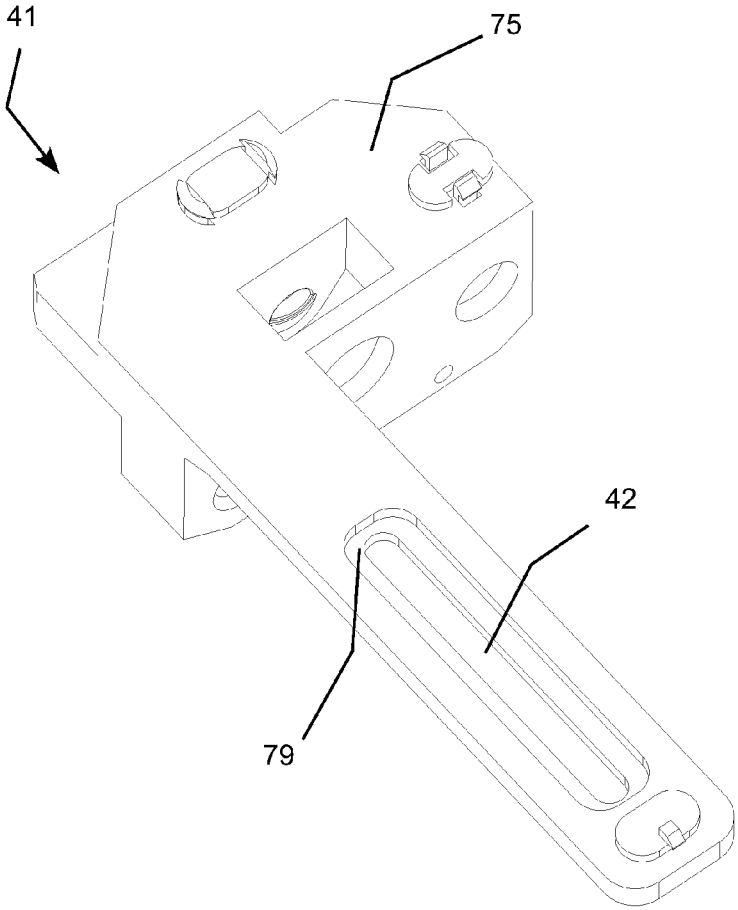
FIG. 11 is a perspective view of the rear side of the guide frame for the illustrative motor and clutch assembly.

FIG. 10 is a perspective view of the front side and FIG. 11 is a perspective view of the rear side of the guide frame 41, which includes the guide slot 42 in which the slide translates. The guide frame 41 includes a mounting plate 72, which includes a position indicator receptacle 74, a spring housing receptacle 75, and a control rod receptacle 76. The spring housing receptacle 75 includes two guide shafts 77 for the spring mounting prongs 87 on the slide (shown in FIGS. 12 and 13) and third guide receptacle 78 for the guide pin 69 on the drive gear 66 (shown in FIGS. 5 and 9). Movement of the spring mounting prongs 87 within the guide shafts 77 keeps the slide 60 aligned with the guide frame 41. FIG. 11 shows a slot recess 79 that receives spring clips 84*a-c* on the slide (shown in FIG. 12) to clip the slide 60 to the guide frame 41.

Figure 12:
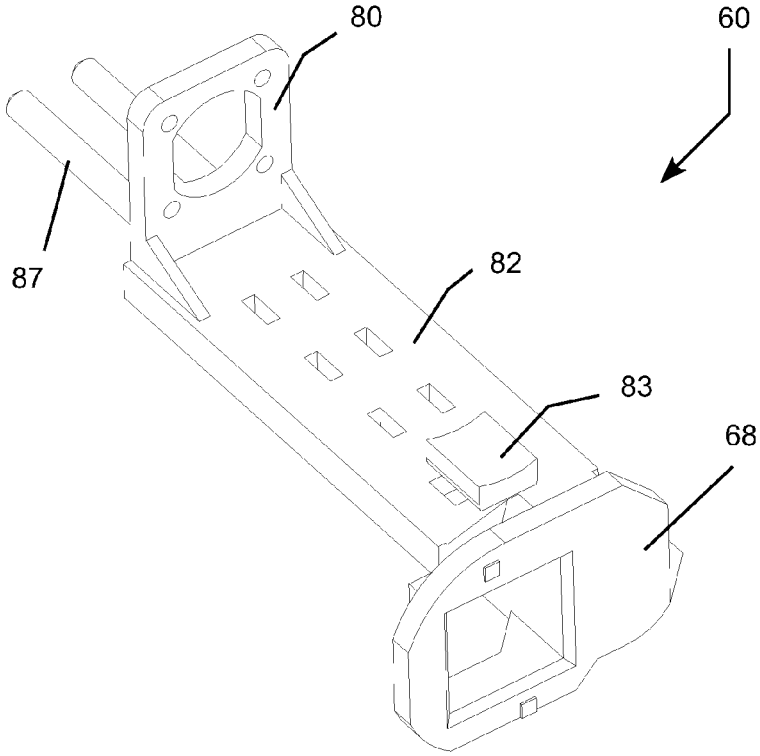
FIG. 12 is a perspective view of the front side of a slide for an illustrative motor and clutch assembly for a remote electrical tilt antenna.
Figure 13:
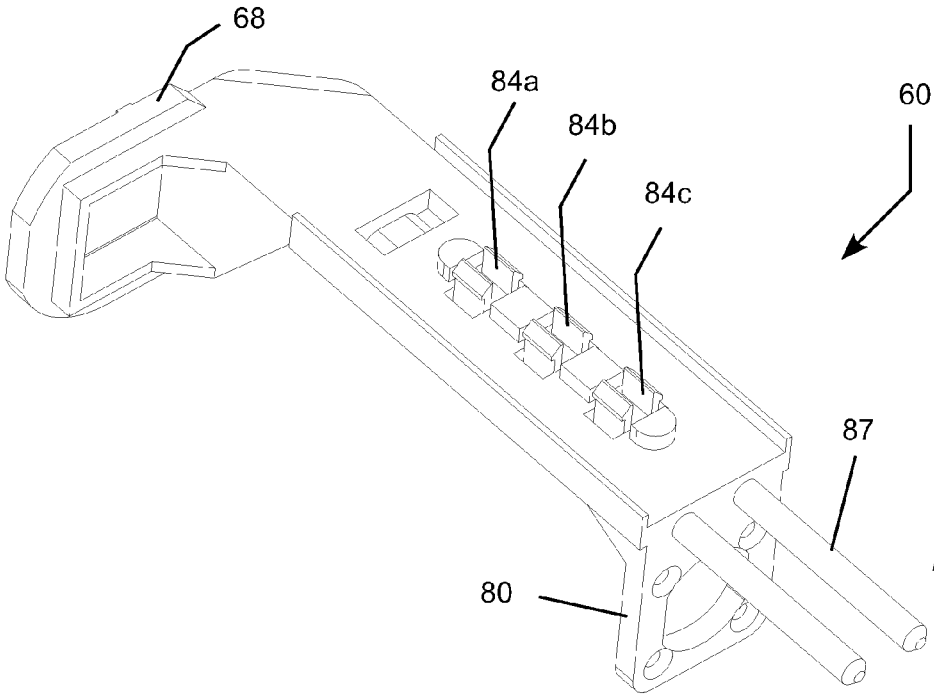
FIG. 13 is a perspective view of the read side of the slide frame for the illustrative motor and clutch assembly.

FIG. 12 is a perspective view of the front side and FIG. 13 is a perspective view of the rear side of the slide 60. The slide includes a slide body 82 between the motor mounting plate 80 at one end and the abutment 68 at the other end. The motor mounting plate 80 includes four screw holes for attaching the front of the gear-motor unit to the slide 60. The slide body 82 includes a tie-down boss 83 for attaching the rear of the gear-motor unit to the slide 60. FIG. 13 shows the spring clips 84*a-c* that snap into the slot 42 and are received within the slot recess 79 shown in FIG. 11. The spring mounting prongs 87, the mounting plate 80 and the abutment 68 are also shown in FIG. 13. The guide frame 41 and slide 60 are preferably fabricated from injection molded plastic.

The invention claimed is:

1. A base station antenna for a telecommunications system comprising:

a plurality of antenna elements for directing a beam of electromagnetic energy in a propagation direction;

a plurality of phase shifters operatively connected to the antenna elements for tilting the beam propagation direction;

a control device operatively connected to the phase shifters for operating the phase shifters to tilt the beam propagation direction;

a gear-motor unit operatively connected to the control device for electro-mechanically driving the control device to tilt the beam propagation direction;

a manual beam tilt mechanism operatively connected to the control device for manually driving the control device to tilt the beam propagation direction; and a clutch operative for disengaging the gear-motor unit from the control device to facilitate manual adjustment of the beam propagation direction and reengaging the gear-motor unit with the control device to permit electro-mechanical adjustment of the beam propagation direction.

2. The antenna of claim 1, further comprising a position detector operatively connected to the control device for registering movement of the control device to track changes in the beam propagation direction, wherein the position detector remains operatively connected to the control device during manual and electro-mechanical adjustment of the beam propagation direction so that beam tilt calibration is not lost during manual or electro-mechanical adjustment of the beam propagation direction.

3. The antenna of claim 1, further comprising a removable cover configured to be selectively attached to the antenna to prevent access to the manual beam tilt mechanism and removed to permit access to the manual beam tilt mechanism, wherein manual removal of the cover operates the clutch to disengage the gear-motor unit from the control device to facilitate manual adjustment of the beam propagation direction, and wherein manual attachment of the cover operates the clutch to reengage the gear-motor unit with the control device to permit electro-mechanical adjustment of the beam propagation direction.

4. The antenna of claim 3, wherein the clutch comprises a spring-loaded plunger mechanism that selectively moves a drive gear unit into and out of engagement with a control gear operatively connected to the control device.

5. The antenna of claim 4, wherein the spring-loaded plunger mechanism comprises a slide supporting the gear-motor unit.

6. The antenna of claim 5, wherein the spring-loaded plunger mechanism further comprises a guide frame that slidably engages the slide supporting the gear-motor unit.

7. The antenna of claim 6, wherein:

the control device comprises a control rod that rotates to adjust the beam propagation direction; and the manual beam tilt mechanism comprises a tilt adjustment knob connected to the control rod for manually rotating the control rod.

8. The antenna of claim 7, wherein:

the antenna is housed within an enclosure;

the control extends through the antenna enclosure;

the tilt adjustment knob is connected to the control rod outside and proximate to the antenna enclosure.

9. The antenna of claim 8, wherein the removable cover selectively attaches to the antenna enclosure to cover tilt adjustment knob.

10. The antenna of claim 9, wherein:

the removable cover comprises a collar configured to be manually inserted into the antenna enclosure to push the spring-loaded plunger mechanism against a spring bias of the mechanism to move the drive gear into engagement with the control gear when the cover is attached to the antenna enclosure; and the spring-loaded plunger mechanism is configured to move under the spring bias of the mechanism to disengage the drive gear from the control gear when the collar of the removable cover is manually removed from the antenna enclosure.

11. The antenna of claim 10, further comprising a tilt indicator operatively carried by the control rod located at least partially outside the antenna enclosure visually indicating a tilt setting associated with the beam propagation direction.

12. The antenna of claim 11, wherein the removable cover comprises a sight tube permitting visual access to the tilt indicator when the removable cover is attached to the antenna enclosure and covering the tilt indicator.

13. The base station antenna of claim 1, wherein the plurality of antenna elements, plurality of phase shifters, control device, gear-motor unit, manual beam tilt mechanism, and clutch as associated with a first antenna array, further comprising one or more additional similarly equipped antenna arrays supported within a common antenna enclosure.

14. The base station antenna of claim 13, wherein the antenna comprises three dual polarization antenna arrays supported within the common antenna enclosure.

15. A base station antenna for a telecommunications system comprising:

a plurality of antenna elements for directing a beam of electromagnetic energy in a propagation direction;

a plurality of phase shifters operatively connected to the antenna elements for tilting the beam propagation direction;

a control device operatively connected to the phase shifters for operating the phase shifters to tilt the beam propagation direction;

a gear-motor unit operatively connected to the control device for electro-mechanically driving the control device to tilt the beam propagation direction;

a manual beam tilt mechanism operatively connected to the control device for manually driving the control device to tilt the beam propagation direction;

a clutch operative for disengaging the gear-motor unit from the control device to facilitate manual adjustment of the beam propagation direction and reengaging the gear-motor unit with the control device to permit electro-mechanical adjustment of the beam propagation direction;

a position detector operatively connected to the control device for registering movement of the control device to track changes in the beam propagation direction, wherein the position detector remains operatively connected to the control device during manual and electro-mechanical adjustment of the beam propagation direction so that beam tilt calibration is not lost during manual or electro-mechanical adjustment of the beam propagation direction; and a removable cover configured to be selectively attached to the antenna to prevent access to the manual beam tilt mechanism and removed to permit access to the manual beam tilt mechanism, wherein manual removal of the cover operates the clutch to disengage the gear-motor unit from the control device to facilitate manual adjustment of the beam propagation direction, and wherein manual attachment of the cover operates the clutch to reengage the gear-motor unit with the control device to permit electro-mechanical adjustment of the beam propagation direction.

16. The base station antenna of claim 15, wherein the plurality of antenna elements, plurality of phase shifters, control device, gear-motor unit, manual beam tilt mechanism, and clutch as associated with a first antenna array, further comprising one or more additional similarly equipped antenna arrays supported within a common antenna enclosure.

17. The base station antenna of claim 16, wherein the antenna comprises three dual polarization antenna arrays supported within the common antenna enclosure.

18. The antenna of claim 15, wherein:

the clutch comprises a spring-loaded plunger mechanism that selectively moves a drive gear unit into and out of engagement with a control gear operatively connected to the control device;

the spring-loaded plunger mechanism comprises a slide supporting the gear-motor unit; and the spring-loaded plunger mechanism further comprises a guide frame that slidably engages the slide supporting the gear-motor unit.

19. The antenna of claim 18, wherein:

the antenna is housed within an enclosure;

the control device comprises a control rod that rotates to adjust the beam propagation direction;

the manual beam tilt mechanism comprises a tilt adjustment knob connected to the control rod for manually rotating the control rod;

the control extends through the antenna enclosure;

the tilt adjustment knob is connected to the control rod outside and proximate to the antenna enclosure;

the removable cover selectively attaches to the antenna enclosure to cover tilt adjustment knob;

the removable cover comprises a collar configured to be manually inserted into the antenna enclosure to push the spring-loaded plunger mechanism against a spring bias of the mechanism to move the drive gear into engagement with the control gear when the cover is attached to the antenna enclosure; and the spring-loaded plunger mechanism is configured to move under the spring bias of the mechanism to disengage the drive gear from the control gear when the collar of the removable cover is manually removed from the antenna enclosure.

20. The antenna of claim 19, further comprising a tilt indicator operatively carried by the control rod located at least partially outside the antenna enclosure visually indicating a tilt setting associated with the beam propagation direction, wherein the removable cover comprises a sight tube permitting visual access to the tilt indicator when the removable cover is attached to the antenna enclosure and covering the tilt indicator.

* * * * *